US006351182B1

(12) United States Patent
Drapkin et al.

(10) Patent No.: US 6,351,182 B1
(45) Date of Patent: Feb. 26, 2002

(54) CIRCUIT AND METHOD FOR PROVIDING A REFERENCE VOLTAGE

(75) Inventors: Oleg Drapkin; Grigori Temkine, both of Toronto (CA)

(73) Assignee: ATI International SRL, Barbados (KN)

( * ) Notice: Subject to any disclaimer, the term of this patent is extended or adjusted under 35 U.S.C. 154(b) by 0 days.

(21) Appl. No.: 09/365,570

(22) Filed: Aug. 2, 1999

(51) Int. Cl.[7] ..... G05F 1/46
(52) U.S. Cl. ..... 327/543; 327/541; 323/315
(58) Field of Search ..... 327/540, 541, 327/543; 323/313, 315

(56) References Cited

U.S. PATENT DOCUMENTS 4,578,633 A * 3/1986 Aoki ..... 323/315
4,697,154 A * 9/1987 Kousaka et al. ..... 323/315
5,838,188 A * 11/1998 Taguchi ..... 327/530

* cited by examiner

*Primary Examiner*—Timothy P. Callahan
*Assistant Examiner*—Terry L. Englund
(74) *Attorney, Agent, or Firm*—Vedder, Price, Kaufman & Kammholz

(57) ABSTRACT

A circuit and method for providing a reference voltage includes controlling a plurality of current sources which are passive during generation of a reference voltage within a suitable operating range, but which are active during corrective portions when the reference voltage varies outside of a suitable operating range. A plurality of sensing elements is used in connection with the current sources to provide feedback to maintain the reference voltage within a suitable operating range. In one embodiment, all circuit elements are made of a single gate oxide thickness.

16 Claims, 2 Drawing Sheets

CIRCUIT AND METHOD FOR PROVIDING A REFERENCE VOLTAGE

FIELD OF THE INVENTION

The invention relates generally to integrated circuits having circuits that provide reference voltages, and more particularly to reference voltage circuits and methods for providing reference voltages circuits that may be single gate oxide circuits and may provide relatively strong immunity to noise and draw low amounts of current.

BACKGROUND OF THE INVENTION

Submicron technologies for very large scale integration (VLSI) circuits use, for example, 0.25 micrometer, 0.18 micrometer or less gate lengths have very low supply voltages, such as 2.5 V, 1.8 V or lower supplies. Such integrated circuits may include, for example, graphics processing chips, microprocessors and any other suitable integrated circuits. Where the integrated circuits employ MOSFETS or other technology, gate to source and gate to drain voltage potentials have to be maintained within a safe operating level to avoid damage to the circuit elements. However, supply voltages and input signal voltages to circuits that make up the integrated circuit can far exceed the gate to source and gate to drain safe operating voltages. Moreover, where single gate oxide circuits are used, such as where all circuit elements are of a single gate oxide thickness, a designer must typically generate internal reference generated voltage levels that are larger than 0 V but less than the voltage supply level to help provide safe gate to source and gate to drain voltages.

One solution to generate reference voltages within an integrated circuit, includes the use of a simple resistor divider. However, such resistor dividers can consume DC current. This can be a severe drawback where low current requirements are necessary.

Another mechanism to generate additional reference voltages includes using a middle floating point of two circuit elements that in the off condition, avoid current draw, such as serially connected reverse biased diodes. These circuits can provide, for example, a potential one-half of the supply voltage to the serially connected diodes. However, such a configuration can allow noise coupling which changes the potential of the reference level.

Consequently, a need exists for an improved reference voltage generating circuit and method, that has improved noise immunity, and that consumes small amounts of current during operation. It will also be advantageous if such a circuit could be fabricated as a single gate oxide circuit to reduce fabrication complexity.

BRIEF DESCRIPTION OF THE DRAWINGS

The disclosed invention will be more readily understood in view of the following figures, wherein.

DETAILED DESCRIPTION OF A PREFERRED EMBODIMENT OF THE INVENTION

Briefly, a circuit and method for providing a reference voltage includes controlling a plurality of current sources which are passive during generation of a reference voltage within a suitable operating range, but which are active during corrective portions when the reference voltage varies outside of a suitable range. A plurality of sensing elements are used in connection with the current sources to provide feedback to maintain the reference voltage within a suitable voltage range. In one embodiment, all circuit elements are made of a single gate oxide thickness.

Figure 1:
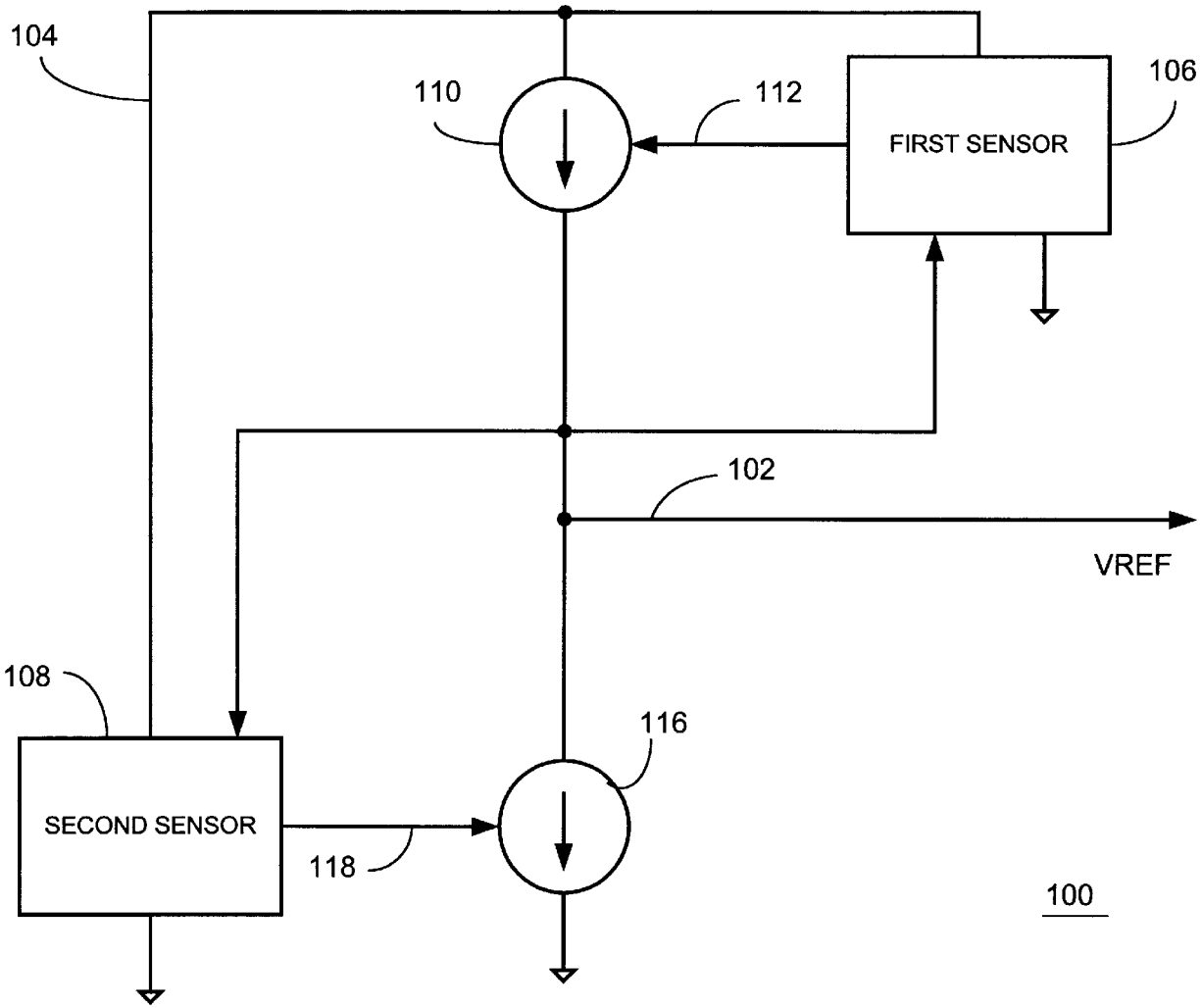
FIG. 1 is a block diagram of a circuit providing a reference voltage in accordance with one embodiment of the invention.

FIG. 1 illustrates one embodiment of a circuit 100 that provides a reference voltage 102. The circuit 100 uses a supply voltage 104, such as a supply voltage of core circuitry, such as a 2.5 V DC supply voltage, 1.8 V, 1.2 V or any other suitable voltage. The circuit 100 includes a first sensor, such as a reference voltage pull up sensor 106, operatively coupled to sense the reference voltage 102, a second sensor, such as a reference pull down sensor 108, that is operatively coupled to also sense the reference voltage 102. A current source 110 is operatively coupled to the reference voltage pull up sensor 106 through sensor output signal 112. The current source 110 is also operatively coupled to the supply voltage 104 and outputs the reference voltage 102. A second current source 116 is operatively coupled to the current source 110 by also outputting the reference voltage 102, and also receives sense output signal 118 from the reference pull down sensor 108. The sense signals 112 and 118 control the current sources 110 and 116 in response to the pull up and pull down sensors to maintain the reference voltage 102 within a suitable voltage range. The suitable voltage range is determined, at least in part, by one or more voltage drops related to the reference voltage pull down sensor 108 and pull up sensor 106. As shown, the first sensor 106 receives the reference voltage 102 as feedback. Likewise, the second sensor 108 also receives the reference voltage 102 as feedback to continually sense the level of the reference voltage.

The current sources 110 and 116 are passive (e.g., off) when the reference voltage 102 is within the suitable voltage range. The current sources 110 and 116 are controllably activated through sense output signals 112 and 118 to regulate the reference voltage 102 when the reference voltage 102 is detected to be out of a suitable voltage range. Accordingly, the current sources 110 and 116 are effectively off when the voltage reference is within the suitable voltage range and they are only turned on, and draw current, when they are needed to correct the voltage reference level.

As such, the circuit 100 senses the reference voltage 102 using the first sensor and senses the reference voltage 102 also using the second sensor 108. The circuit 100 controls the current source 110 to maintain the reference voltage 102 within a suitable voltage range and also controls the current source 116 to maintain the reference voltage within a suitable voltage range. The reference voltage pull up sensor 106 and corresponding current source 110 activate to pull up the reference voltage 102 to a higher level when it goes below the desired limit on the low end of the range. The reference voltage pull down sensor 108 and corresponding current source 116 are used to pull the voltage reference 102 level lower when it exceeds the high end of the suitable voltage range. Since the current sources 110 and 116 are effectively off when the reference voltage is within the range, little current is drawn. In addition, any noise coupled on the VREF 102 line is also effectively removed since the closed loop feedback control of the reference voltage protects against variations caused by coupled noise.

Figure 2:
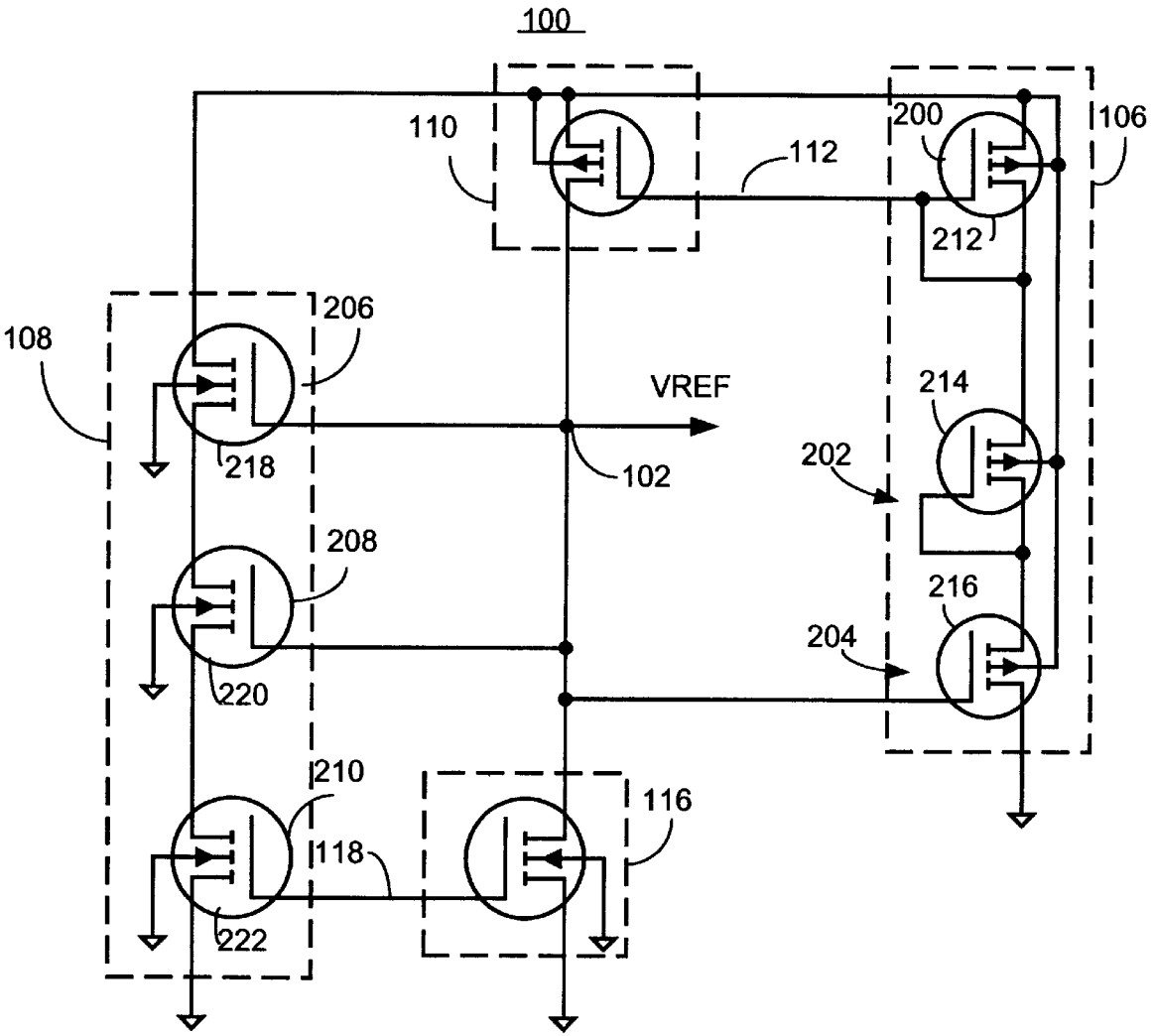
FIG. 2 is one example of a circuit for providing a reference voltage in accordance with one embodiment of the invention.

Referring to FIG. 2, one example of the circuit 100 is shown wherein the voltage drops to set the range of the reference voltage are provided by circuit elements 200–210.

In this example, each of the plurality of circuit elements 200–210 are capable of having diode voltage and current characteristics. In this particular example, the reference voltage pull down sensor 108 and the reference voltage pull up sensor 106 each include mosfet transistors. In particular, the reference voltage pull up sensor 106 includes a plurality of circuit elements 200–204 which are configured as cascaded pmos transistors. The circuit element 200 is configured as a diode as well as the circuit element 202.

The reference voltage pull down sensor 108 includes a plurality of circuit elements configured as cascaded nmos transistors 206 through 210. Elements 208 and 210 are configured as diodes. However, it will be recognized that any suitable circuit elements having characteristics where there is a rapid change in impedance can be used. In addition, it will be recognized that fewer or more elements can be used in the sensors depending upon the desired range for the reference voltage. In this example, the reference voltage is set to be within the range according to the following formula:

$$\text{VDD CORE}-3_{VTP}<\text{VREF}<3_{VTN}.$$

The current source 110 is shown in this embodiment to be a pmos transistor, and the current source 116 is shown to be an nmos transistor. However, any suitable voltage controlled or current controlled current source may be used.

As shown, the plurality of cascaded pmos transistors corresponding to elements 200–204 include a first pmos transistor 212 configured as a diode having a gate operatively coupled to the first current source 110, namely to the gate of current source 110. A second pmos transistor 214 is also configured as a diode and is operatively coupled to the first pmos transistor 212. A third pmos transistor 216 has a gate operatively coupled to receive the reference voltage 102.

The sensor 108 includes a first nmos transistor 218 having a gate operatively coupled to the current source 110 and also coupled to receive the reference voltage 102. Another nmos transistor 220 is configured as a diode and coupled between transistor 218 and transistor 222. Transistor 222 is also configured as a diode and has a gate operatively coupled to the current source 116, namely the gate of the current source 116.

In operation, the current sources are controllably activated when the reference voltage is detected by the sensors to be out of a suitable voltage range. The current source 110 is used to pull up the reference voltage and is on, for example, when pmos transistor 216 turns on. The current source 110 effectively pulls up the reference voltage toward the supply voltage 104. The current source 116 is used to pull down the reference voltage 102. As the transistor for the current source 116 turns on, it tries to decrease the reference voltage by sinking current.

When pmos transistor 216 turns on, circuit elements 200 and 202 become active resulting in voltage drops across each element. If the current source 116 decreases the reference voltage more than the supply voltage minus the three threshold drops across the pmos devices (VDD CORE–$3V_{TP}$), then transistor 216 turns on, thereby turning on transistors 212 and 214 and the current source 110 resulting in increasing the reference voltage higher then VDD CORE–$3V_{tp}$.

Transistor 218 controls the overvoltage of the reference voltage since the reference voltage is fed back through this circuit element. Transistor 218 turns on when the reference voltage is higher than three voltage threshold drops associated with the nmos transistors 218–222. When transistor 218 turns on, so do transistors 220 and 222. This controls the current source 116 to become active and sink current to reduce the reference voltage 102. The circuit may be suitably modified as indicated above, by adding or removing circuit elements such as 220 and 214 to vary the suitable voltage range over which to regulate the reference voltage.

The reference voltage pull up sensor 106 and the current source 110 are coupled to form a current mirror configuration. Similarly, the reference voltage pull down sensor 108 and the current source 116 are coupled in this embodiment, to form a second current mirror configuration. However, it will be recognized that other embodiments may avoid using current mirrors and may use any suitable configuration if desired. In addition, to facilitate cost-efficient fabrication, all of circuit elements shown in FIG. 2 are made of a single gate oxide thickness, for example, such as 0.25 micrometers, where the voltage supply is 2.5 V. As such, this reference voltage circuit can be a cost effective circuit for generating desired voltage levels in an integrated circuit.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. A circuit for providing a reference voltage comprising:

a reference voltage pull up sensor operatively coupled to sense when the reference voltage falls below a low end of a suitable operating range of the reference voltage;

a reference voltage pull down sensor operatively coupled to sense when the reference voltage rises above a high end of the suitable operating range of the reference voltage;

a first current source, operatively coupled to the reference voltage pull up sensor, which is off if the reference voltage is above the low end of the suitable operating range;

a second current source, operatively coupled to the first current source and to the reference voltage pull down sensor, which is off if the reference voltage is below the high end of the suitable operating range of the reference voltage; and wherein the first and second current sources are controlled to be active in response to the reference voltage pull up and reference voltage pull down sensors to maintain the reference voltage within the suitable operating range.

2. The circuit of claim 1 wherein the reference voltage pull up sensor and the first current source are operatively coupled to form a first current mirror configuration and wherein the reference voltage pull down sensor and the second current source are operatively coupled to form a second current mirror configuration.

3. The circuit of claim 1 wherein the reference voltage pull up sensor includes a first plurality of circuit elements having diode voltage and current characteristics, and wherein the reference voltage pull down sensor includes a second plurality of circuit elements having diode voltage and current characteristics.

4. The circuit of claim 3 wherein the first plurality of circuit elements include a plurality of cascaded pmos transistors and wherein the second plurality of circuit elements includes a plurality of cascaded nmos transistors.

5. The circuit of claim 4 wherein the plurality of cascaded pmos transistors include a first pmos transistor configured as a diode and having a gate operatively coupled to the first current source, a second pmos transistor configured as a diode and operatively coupled to the first pmos transistor, and a third pmos transistor operatively coupled to the second pmos transistor and having a gate operatively coupled to the reference voltage and to the second current source.

6. The circuit of claim 5 wherein the plurality of cascaded nmos transistors include a first nmos transistor having a gate operatively coupled to the reference voltage and to the first current source, a second nmos transistor configured as a diode and operatively coupled to the first nmos transistor, and a third nmos transistor configured as a diode and operatively coupled to the second nmos transistor and to the second current source.

7. A circuit for providing a reference voltage comprising:

a reference voltage pull up sensor operatively coupled to sense when the reference voltage falls below a low end of a suitable operating range of the reference voltage;

a reference voltage pull down sensor operatively coupled to sense when the reference voltage rises above a high end of the suitable operating range of the reference voltage;

a first current source, operatively coupled to the reference voltage pull up sensor, which is off if the reference voltage is above the low end of the suitable operating range;

a second current source, operatively coupled to the first current source and to the reference voltage pull down sensor, which is off if the reference voltage is below the high end of the suitable operating range of the reference voltage; and wherein the first and second current sources are controlled in response to the pull up and pull down sensors to maintain the reference voltage within the suitable operating range and wherein the voltage range is determined at least in part by one or more voltage drops related to each of the reference voltage pull down sensor and the reference voltage pull up sensor.

8. The circuit of claim 7 wherein the reference voltage pull up sensor and the first current source are operatively coupled to form a first current mirror configuration and wherein the reference voltage pull down sensor and the second current source are operatively coupled to form a second current mirror configuration.

9. The circuit of claim 7 wherein the reference voltage pull up sensor includes a first plurality of circuit elements having diode voltage and current characteristics, and wherein the reference voltage pull down sensor includes a second plurality of circuit elements having diode voltage and current characteristics.

10. The circuit of claim 9 wherein the first plurality of circuit elements includes a plurality of cascaded pmos transistors and wherein the second plurality of circuit elements includes a plurality of cascaded nmos transistors.

11. The circuit of claim 10 wherein the plurality of cascaded pmos transistors include a first pmos transistor configured as a diode and having a gate operatively coupled to the first current source, a second pmos transistor configured as a diode and operatively coupled to the first pmos transistor, and a third pmos transistor operatively coupled to the second pmos transistor and having a gate operatively coupled to the reference voltage and to the second current source.

12. The circuit of claim 11 wherein the plurality of cascaded nmos transistors include a first nmos transistor having a gate operatively coupled to the reference voltage and to the first current source, a second nmos transistor configured as a diode and operatively coupled to the first nmos transistor, and a third mnos transistor configured as a diode and operatively coupled to the second nmos transistor and to the second current source.

13. The circuit of claim 12 wherein the nmos and pmos transistors and the current sources each are made of a single gate oxide thickness.

14. A method for providing a reference voltage comprising:

sensing when the reference voltage falls below a low end of a suitable operating range of the reference voltage using a first sensor;

sensing when the reference voltage rises above a high end of the suitable operating range of the reference voltage using a second sensor;

controlling a first current source, operatively coupled to the first sensor, to be off when the reference voltage is within the suitable operating range, and to be on when the reference voltage is detected to be below the low end of the suitable operating range; and controlling a second current source, operatively coupled to the first current source, to be off when the reference voltage is within the operating range, and to be on when the reference voltage is detected to be above the high end of the suitable operating range.

15. The method of claim 14 wherein the operating range is determined at least in part by one or more voltage drops related to each of the first and second sensors.

16. The method of claim 14 wherein the first and second sensors each include a plurality of circuit elements having diode voltage and current characteristics.

* * * * *